US007401441B2

(12) United States Patent
Zimmerle et al.

(10) Patent No.: US 7,401,441 B2
(45) Date of Patent: Jul. 22, 2008

(54) CHANNELED FLOOR COVERING

(75) Inventors: Johnny W. Zimmerle, St. Joseph, MI (US); Todd C. Starr, St. Joseph, MI (US); Wyatt A. Cline, Niles, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 714 days.

(21) Appl. No.: 10/895,235

(22) Filed: Jul. 20, 2004

(65) Prior Publication Data

US 2005/0055937 A1 Mar. 17, 2005

Related U.S. Application Data

(63) Continuation-in-part of application No. 29/186,073, filed on Jul. 9, 2003, now Pat. No. Des. 496,472.

(51) Int. Cl.
*E04F 11/16* (2006.01)
*A01K 1/00* (2006.01)

(52) U.S. Cl. ..... 52/177; 119/525

(58) Field of Classification Search ..... 52/177, 52/302.1, 302.3, 384, 506.1; 119/525, 526, 119/527, 450; 404/19, 32, 35
See application file for complete search history.

(56) References Cited

U.S. PATENT DOCUMENTS

| | | | | |
|---|---|---|---|---|
| 1,948,327 | A | 2/1934 | Berwick | |
| D95,158 | S | 4/1935 | Surerus | |
| 2,512,310 | A | 6/1950 | Corson | |
| 4,242,390 | A | 12/1980 | Nemeth | 428/47 |
| 4,512,044 | A | 4/1985 | Clark | 4/581 |
| 5,478,625 | A * | 12/1995 | Wright | 428/119 |
| 5,626,933 | A | 5/1997 | Long | 428/52 |
| 5,630,304 | A | 5/1997 | Austin | 52/384 |
| D423,440 | S | 4/2000 | Sneed | |
| 6,062,162 | A | 5/2000 | Dean | 116/28 |
| 6,120,876 | A | 9/2000 | Walton | 428/137 |
| 6,202,689 | B1 * | 3/2001 | Williams | 137/602 |
| 6,301,848 | B1 | 10/2001 | Whitaker | 52/302.1 |
| D455,383 | S | 4/2002 | Sneed | D12/203 |
| 2003/0148071 | A1 | 8/2003 | Sneed | 428/137 |
| 2004/0079040 | A1 * | 4/2004 | MacLean et al. | 52/302.1 |

* cited by examiner

*Primary Examiner*—Richard E. Chilcot, Jr.
*Assistant Examiner*—Anthony N Bartosik
(74) *Attorney, Agent, or Firm*—Tara M. Hartman; Michael D. LaFrenz

(57) ABSTRACT

A floor covering main body comprising an intermediate channeled surface. A plurality of non-contiguous but adjacent lugs extends upwardly from the intermediate channeled surface. A substantially planar composite upper surface is disposed above the intermediate surface and is defined by the top surfaces of the lugs. The intermediate channeled surface carries or channels liquid away from the upper walking surface. A plurality of floor covering main bodies can be aligned to form a flooring system. In another configuration, some or all of the lugs may be contiguous.

38 Claims, 10 Drawing Sheets

CHANNELED FLOOR COVERING

CROSS-REFERENCE TO RELATED APPLICATION

This application is a continuation-in-part of U.S. patent application Ser. No. 29/186,073 entitled "Tread Plate Flooring" and filed on Jul. 9, 2003, the entire contents of which are hereby incorporated herein by reference.

BACKGROUND OF THE INVENTION

1. Field of the Invention

This invention relates, generally, to a floor covering having a liquid channeling means disposed below a walking surface, and more particularly to a floor covering having an upwardly oriented liquid channeling surface and a walking surface disposed thereabove and defined by a plurality of lugs extending upwardly from the liquid channeling surface.

2. Description of Related Art

Floor coverings that collect or direct liquids of various types are known in the prior art. These floor coverings are utilized in many environments such as garages and factories.

For example, in the garage environment it is common to have melting snow, mud, and lubricants find their way to the garage floor. Besides creating an untidy environment, elements such as these may accelerate the deterioration of the floor. Even worse, they may increase the potential for slip and fall accidents. The floor covering designs of the prior art have tried to address these issues, but have not done an adequate job. Specifically, the designs of the prior art may contain or channel liquids, but none provide a walking surface that adequately separates someone from the liquid. Even more, none provide adequate liquid channeling away from the walking surface. Therefore, there exists a need for a new and improved floor covering which can channel liquid away from the walking surface and still allow for relatively easy cleaning.

SUMMARY OF THE INVENTION

In one aspect, the invention relates to a floor covering having a main body. The main body includes a lower surface, a non-planar intermediate surface, and a substantially planar composite upper surface. The lower surface may be planar or non-planar depending on the intended application. The non-planar intermediate surface is comprised of a first raised section, a second raised section, and an intermediate lower region disposed between the first raised section and the second raised section. The intermediate surface aids in channeling liquid away from the upper surface, or from the floor covering in general. A plurality of lugs extend upwardly from the intermediate surface. The lugs can be non-contiguous, contiguous, or a combination of the two. At least some of the lugs may vary in height to create the substantially planar composite upper surface.

In another embodiment, the invention relates to a floor covering main body having a lower surface, an intermediate channeled surface, and a substantially planar composite upper surface. The substantially planar composite upper surface is defined by the top surfaces of a plurality of non-contiguous but adjacent lugs extending upwardly from the intermediate channeled surface. The lug height can increase towards the center of the intermediate channeled surface to help define the substantially planar composite upper surface. The intermediate surface can be undulated, and thus provide multiple liquid carrying channels. A plurality of contiguous lugs can extend upwardly from the intermediate channeled surface. One or more of the top surfaces of the contiguous lugs may contribute in defining the substantially planar composite upper surface. A flooring system can be created by disposing multiple main bodies adjacent each other such that each upper surface aligns with the next adjacent upper surface.

In yet another embodiment, the invention relates to floor covering main body having a lower surface, an intermediate channeled surface, and a substantially planar composite upper surface. The upper surface is defined by some or all of a plurality of contiguous lugs extending upwardly from intermediate channeled surface. The contiguous lugs are configured to allow the intermediate channeled surface to channel liquid away from the composite upper surface. The composite upper surface can serve as a walking surface.

DETAILED DESCRIPTION

Figure 1:
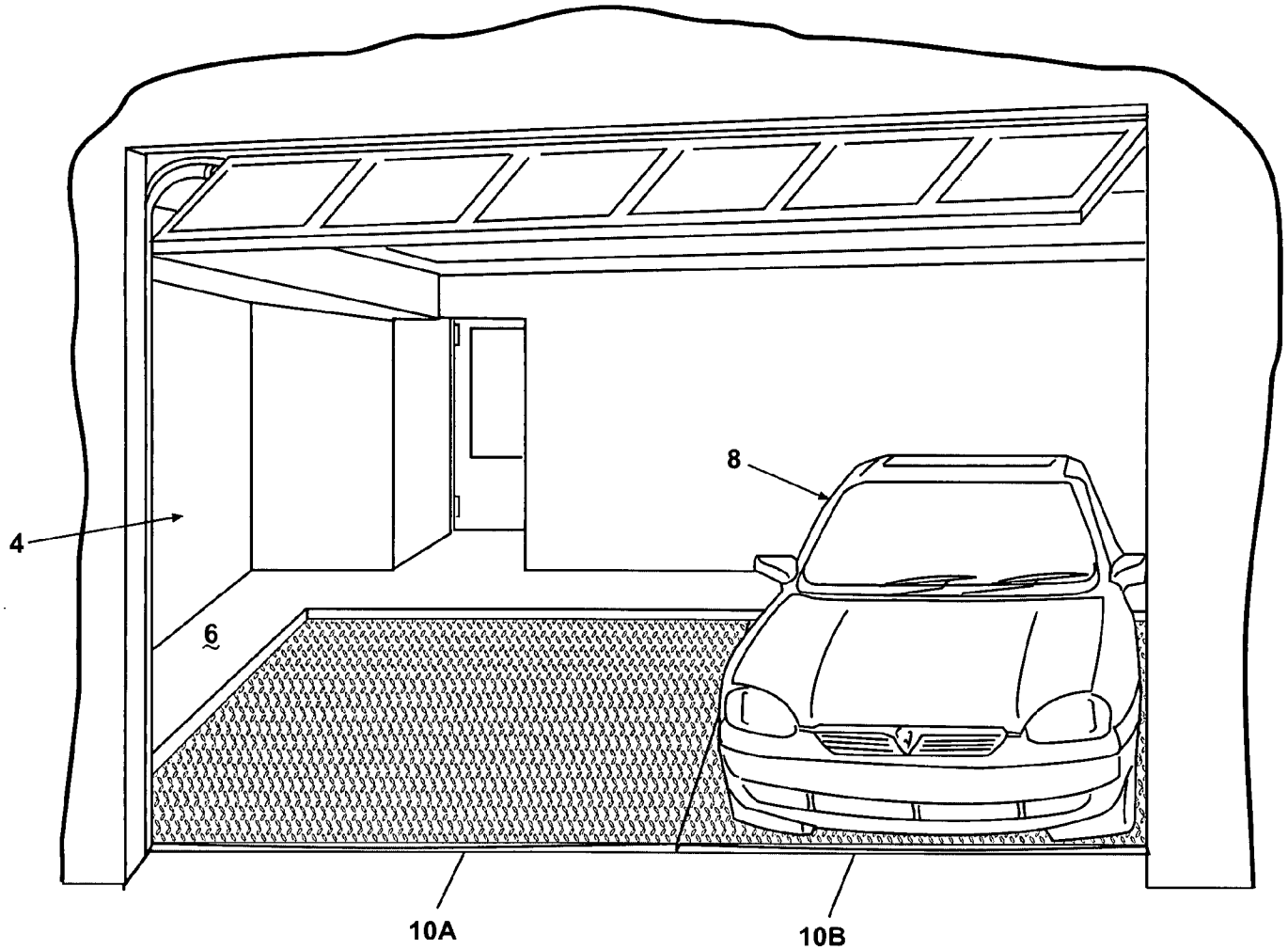
FIG. 1 is a partial front perspective view of a garage incorporating the floor covering of the present invention.
Figure 2:
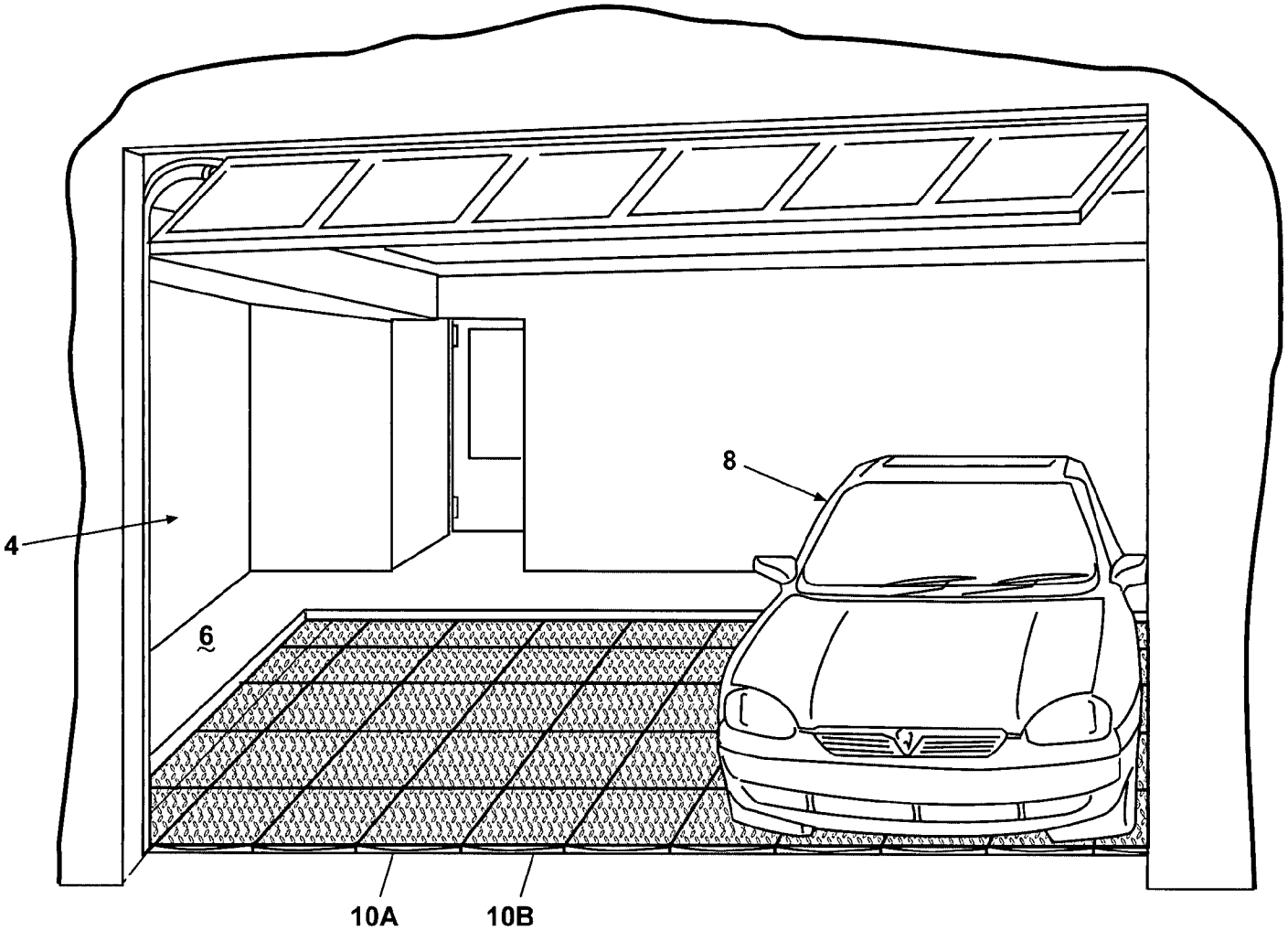
FIG. 2 is a partial front perspective view of the garage of FIG. 1, with an alternate floor covering embodiment of the present invention.

The present invention generally relates to a floor covering having a walking surface disposed above a liquid channeling surface. The invention may be used in a garage environment as shown in FIG. 1 and FIG. 2, on a factory floor, or any application where it is advantageous to channel liquid away from a walking surface. In FIGS. 1-2, a garage 4 is shown having a floor 6. A vehicle 8 is shown disposed above floor covering 10B in FIG. 1 and above multiple flooring units in FIG. 2.

Figure 3:
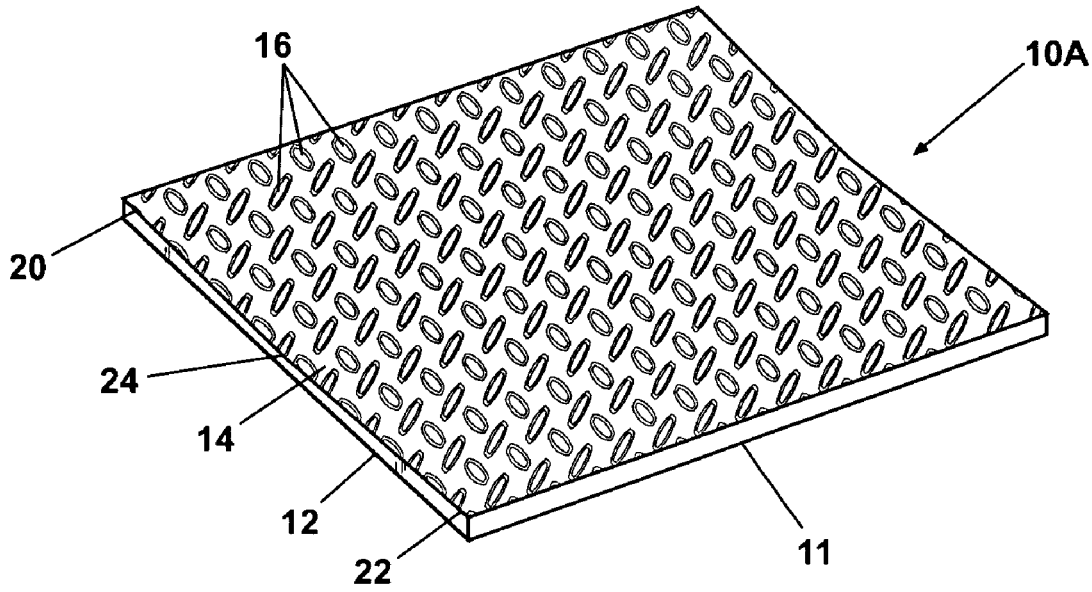
FIG. 3 is an enlarged front perspective view of a piece of floor covering of the type as shown in either FIG. 1 or FIG. 2.
Figure 4:
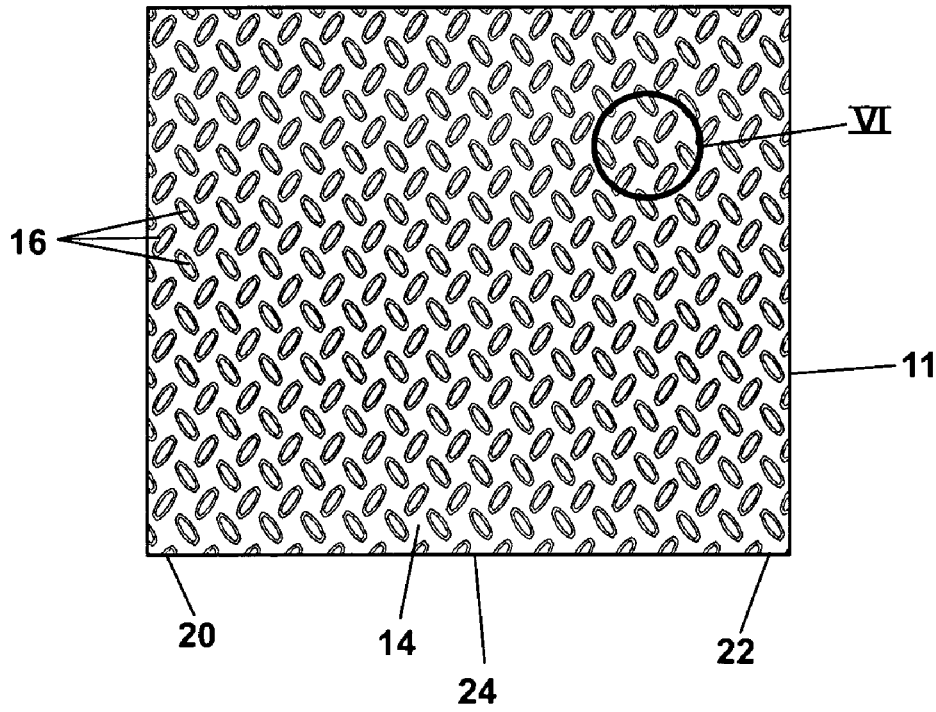
FIG. 4 is a top plan view of the piece of floor covering of FIG. 3.
Figure 5:
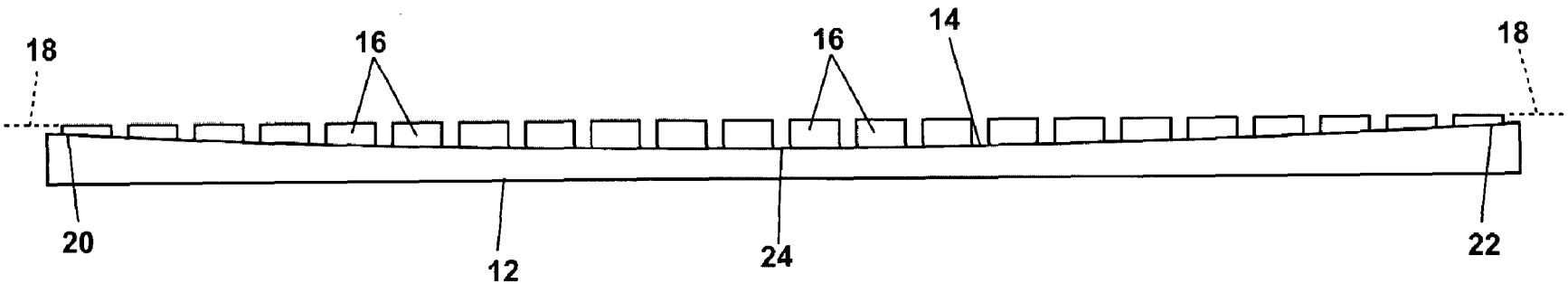
FIG. 5 is an enlarged front elevational view of the piece of floor covering of FIG. 3.

In FIGS. 3-5, a floor covering 10A has a main body 11. Main body 11 includes a lower surface 12, a non-planar intermediate surface 14, a plurality of non-contiguous but adjacent lugs 16, and a substantially planar composite upper surface 18. Intermediate surface 14 includes a first raised section 20, a second raised section 22, and an intermediate lower region 24 disposed between the first raised section 20 and the second raised section 22. Preferably, the intermediate lower region 24 is substantially linear. The intermediate surface 14 slopes upwardly from the intermediate lower region 24 to the first raised section 20, and similarly from the intermediate lower region 24 to the second raised section 22. Together, the first raised section 20, the second raised section 22, and the intermediate lower region 24 define a channel for carrying liquid away from the upper surface 18. Floor covering 10B, as shown in FIGS. 1-2, can be identical or similar to floor covering 10A.

Figure 14:
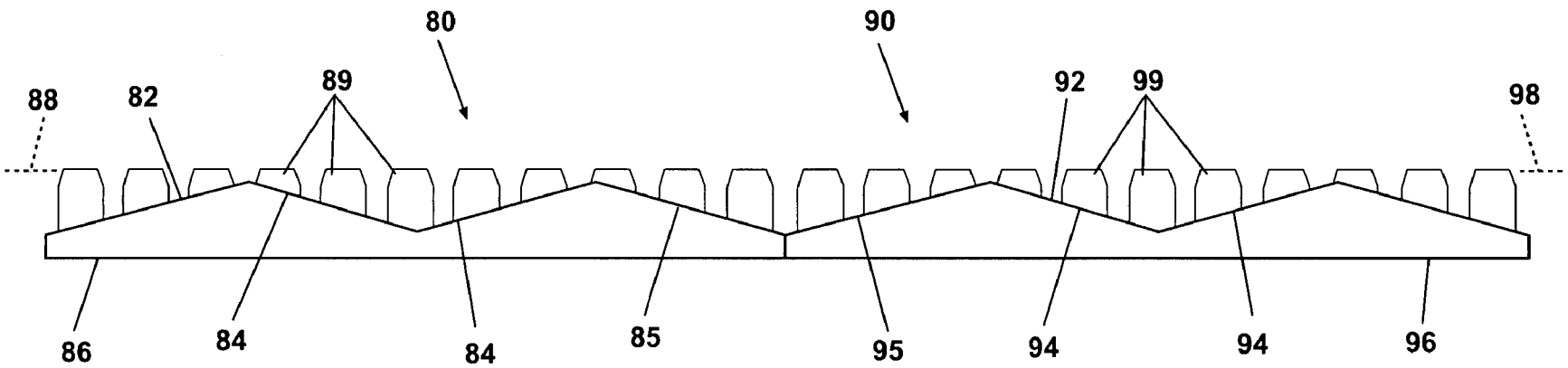
FIG. 14 is an enlarged front elevational view of an alternate floor covering system having two main bodies each with an undulated intermediate surface.

The channel formed from the intermediate surface 14 may take on many forms. As shown in FIG. 5, the channel has gradual sloping surfaces beginning at raised sections 20 and 22, and ending at the intermediate lower region 24. However, as shown in FIG. 14, the intermediate channeled surface may take the form of a "V" shaped channel with steeper sloping surfaces. Additionally, the channel formed from the intermediate surface 14 may deviate from the substantially linear shape as shown in FIGS. 3-5.

The top surfaces of the lugs 16 define the substantially planar composite upper surface 18. Upper surface 18 can be thought of as a virtual surface. Preferably, the composite upper surface 18 is substantially parallel to the lower surface 12. As shown in FIG. 5, the lug height varies between the first raised section 20 and the second raised section 22. Particularly, the lug height increases moving from the first raised section 20 towards the intermediate lower region 24, and then decreases moving from the intermediate lower region 24 to the second raised section 22. The advantage of this design is that a substantially planar upper walking surface is created above an intermediate liquid channeling surface.

Figure 6:
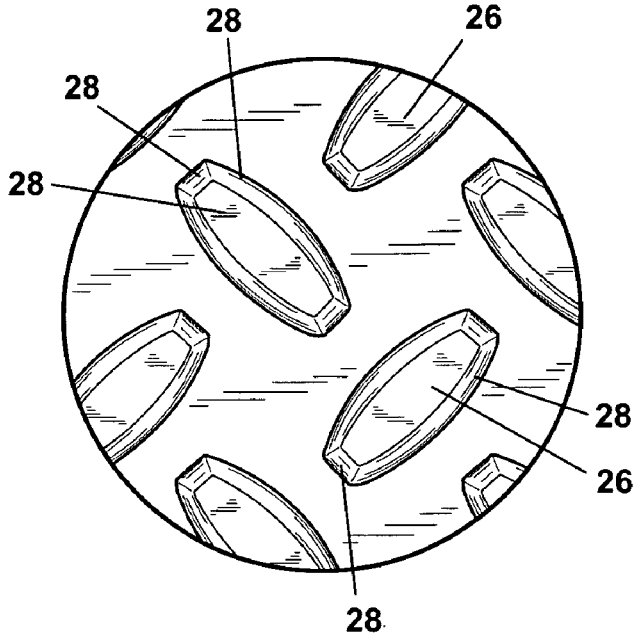
FIG. 6 is an enlarged view of region VI of FIG. 4 showing the details of the lug pattern.
Figure 7:
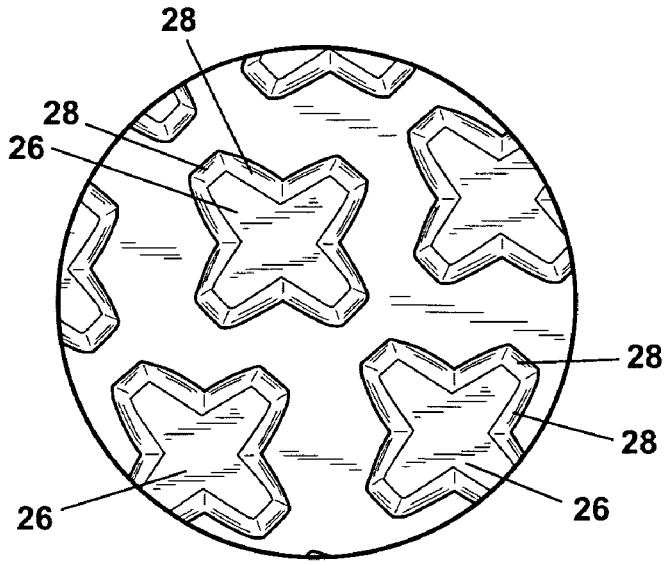
FIG. 7 is an enlarged view of region VI showing an alternate lug pattern.

Lugs 16 extend upwardly from intermediate surface 14 and define a surface for traction. As shown in FIG. 6, lugs 16 have a top surface 26, and side surfaces 28. Preferably, and as shown in FIG. 6, the lugs 16 are much rounder, smoother, and lower in profile than typical "diamond plate" designs. This design offers a smoother interaction with any item or person that contacts the lugs. For example, when a product incorporating wheels or casters moves across the lugs of FIG. 6, there is much less mechanical noise and a reduction in the potential for loosened screws. Lugs 16 are non-contiguous, but adjacent one another. The spacing of the lugs helps promote the relatively free flow of liquid, and provides users the ability to sweep the floor covering with a broom, front to back and side to side with minimal resistance. The lug pattern and shape can vary and still achieve the advantages of the present invention. For example, as shown in FIG. 7, the lugs 16 resemble the shape of the letter "X". Additionally, the lug pattern could serve as more than a walking surface. It could be arranged to form a logo, trademark, or a safety warning such as "CAUTION".

Figure 15:
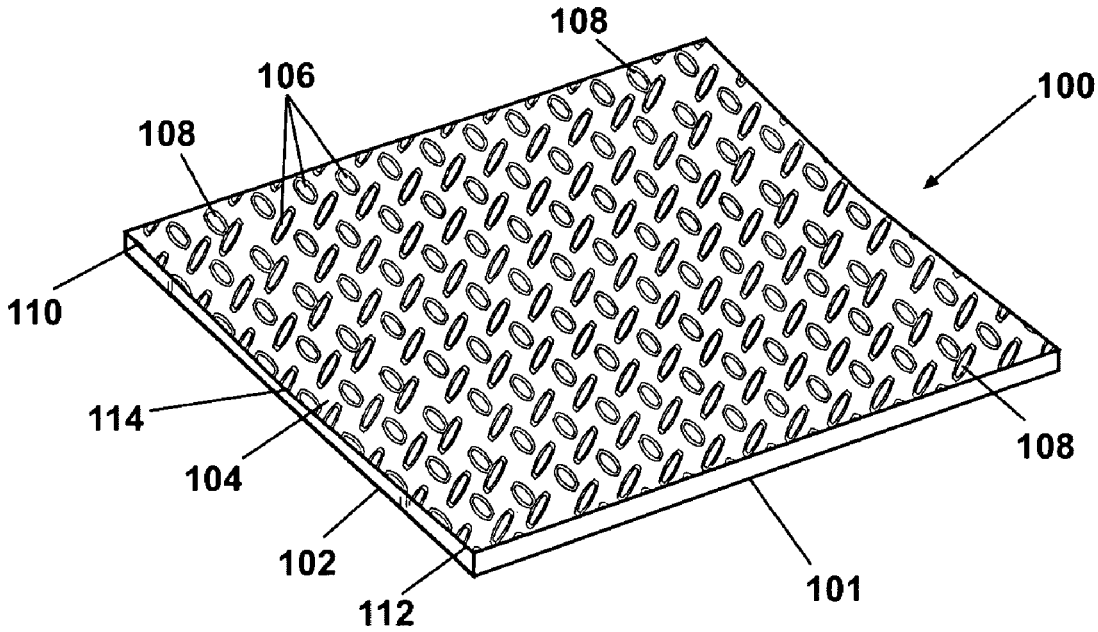
FIG. 15 is an enlarged front perspective view, similar to FIG. 3, showing an alternate floor covering embodiment having a plurality of non-contiguous and contiguous lugs.
Figure 16:
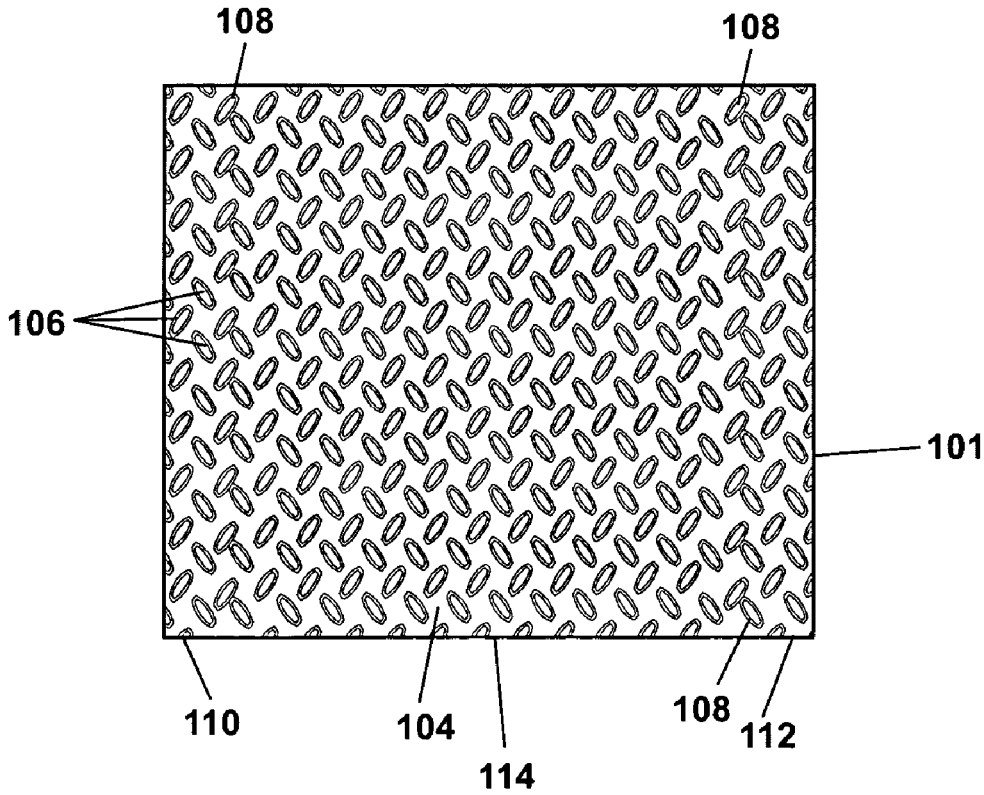
FIG. 16 is a top plan view of the piece of floor covering of FIG. 15.

It is also possible to have some of the lugs touching as shown in FIGS. 15-16. Floor covering 100 has a main body 101. Main body 101 includes a lower surface 102, a non-planar intermediate surface 104, a plurality of non-contiguous but adjacent lugs 106, a plurality of contiguous lugs 108, and a substantially planar composite upper surface formed by the top surfaces of lugs 106 and 108. In this embodiment, both lugs 106 and 108 contribute in defining the composite upper surface. Intermediate surface 104 includes a first raised section 110, a second raised section 112, and an intermediate lower region 114 disposed between the first raised section 110 and the second raised section 112. Preferably, the intermediate lower region 114 is substantially linear. The intermediate surface 104 slopes upwardly from the intermediate lower region 114 to the first raised section 110, and similarly from the intermediate lower region 114 to the second raised section 112. Together, the first raised section 110, the second raised section 112, and the intermediate lower region 114 define a channel for carrying liquid away from the composite upper surface. If desired, all of the lugs could be touching one or more adjacent lugs. However, the lug pattern should not interfere too much with the intermediate channeled surface's ability to carry liquid away from the composite upper surface. Additionally, in any embodiment, it is possible that not all of the contiguous or non-contiguous lugs help define the substantially planar composite upper surface.

Figure 8:
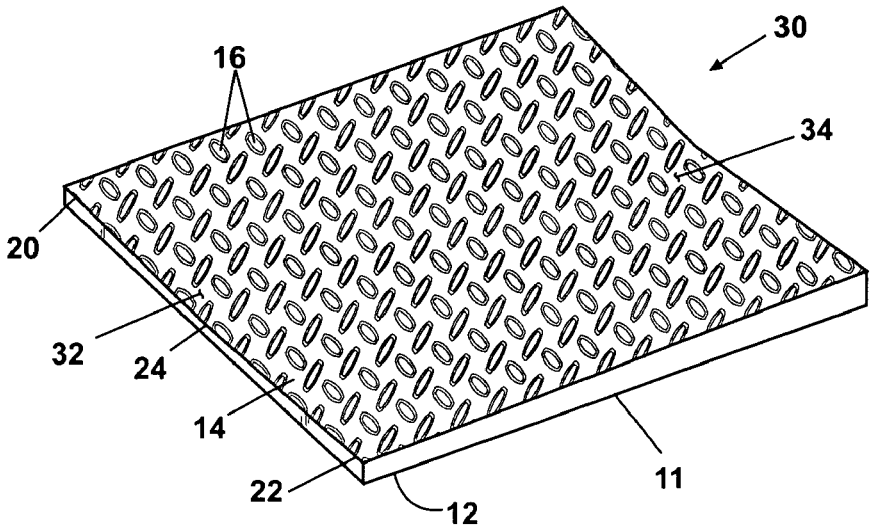
FIG. 8 is an enlarged front perspective view, similar to FIG. 3, showing an alternate floor covering embodiment having a generally sloped rearward to forward section.
Figure 9:
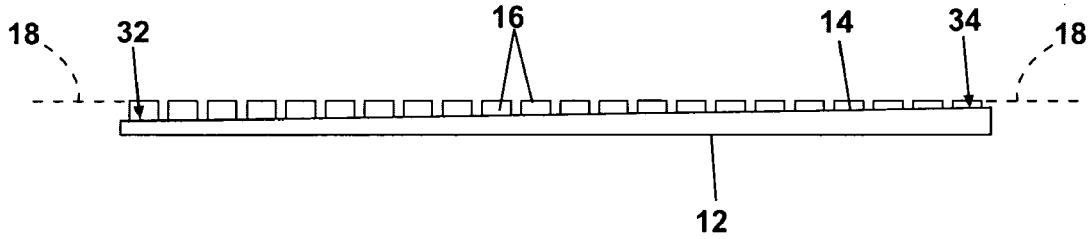
FIG. 9 is an enlarged side elevational view of the floor covering of FIG. 8.

Referring to FIGS. 8-9, floor covering 10A may be modified to form an alternate floor covering embodiment 30. The main body 11 of floor covering embodiment 30 has a lower surface 12, a non-planar intermediate surface 14, a plurality of non-contiguous but adjacent lugs 16, and a substantially planar composite upper surface 18. Intermediate surface 14 includes a first raised section 20, a second raised section 22, and an intermediate lower region 24 disposed between the first raised section 20 and the second raised section 22. The intermediate lower region 24 also includes a forward section 32 and a rearward section 34. The intermediate surface 14 slopes upwardly from the intermediate lower region 24 to the first raised section 20, and similarly from the intermediate lower region 24 to the second raised section 22. Additionally, the intermediate surface 14 slopes downwardly from the rearward section 34 to the forward section 32. Together, the first raised section 20, the second raised section 22, and the intermediate lower region 24 define a channel for carrying liquid away from the walking surface, upper surface 18. In this embodiment, liquid will have a tendency to flow from the rearward section 34 to the forward section 32.

Figure 10:
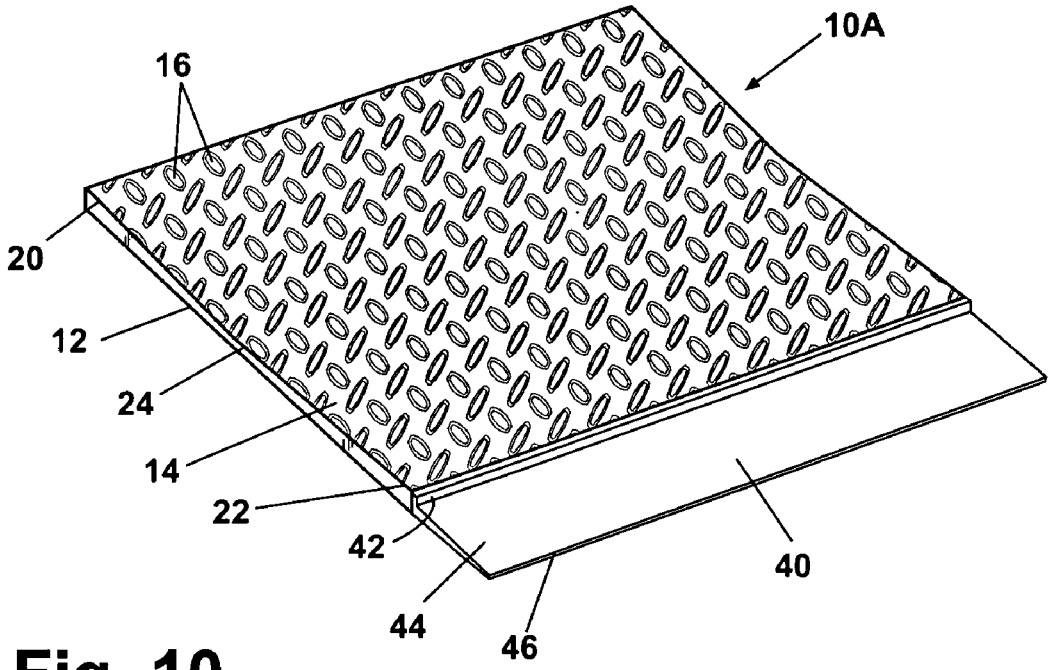
FIG. 10 is an enlarged front perspective view of an alternate floor covering embodiment which has been modified to include a flap or mating surface for engagement with another floor covering.
Figure 11:
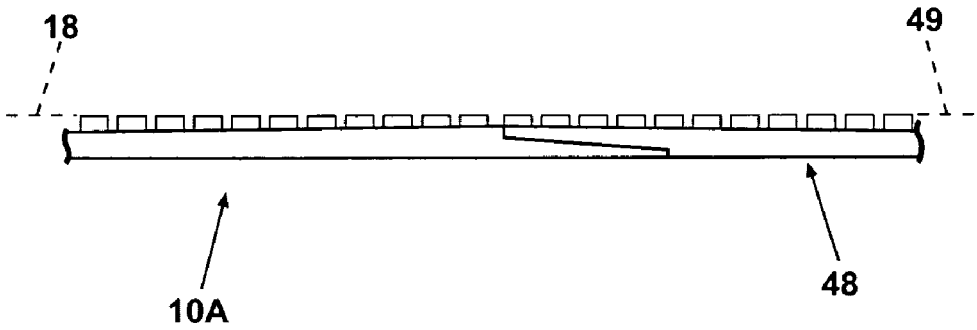
FIG. 11 is a partial enlarged front elevational view of two adjacent pieces of floor covering shown in engagement with each other.

Referring to FIGS. 10-11, the floor covering 10A may be modified to include a mating surface or flap 40 for engagement with another floor covering 48. Thus, a flooring system can be created to cover any size area. Preferably, the flap 40 includes a flat base 42, a tapered surface 44, and a tapered surface end 46. The advantage of this design is that it provides for a "seamless" appearance when multiple floor coverings are engaged with one another, and it also allows for easier cleaning of the entire flooring system. The "seamless" appearance can be achieved by ensuring that the plurality of flooring main bodies are disposed adjacent each other such that each upper surface aligns with the next adjacent upper surface. As shown in FIG. 11, upper surface 18 aligns with upper surface 49.

Figure 12:
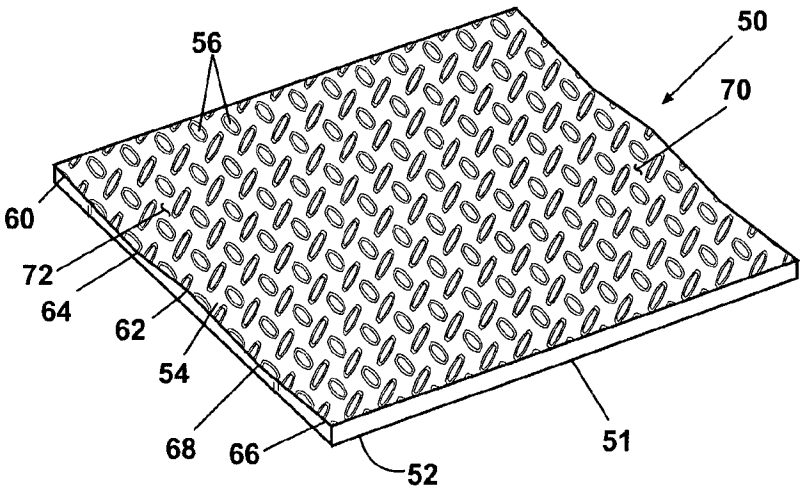
FIG. 12 is an enlarged front perspective view, similar to FIG. 3, showing an alternate floor covering embodiment having multiple intermediate channeled surfaces.
Figure 13:
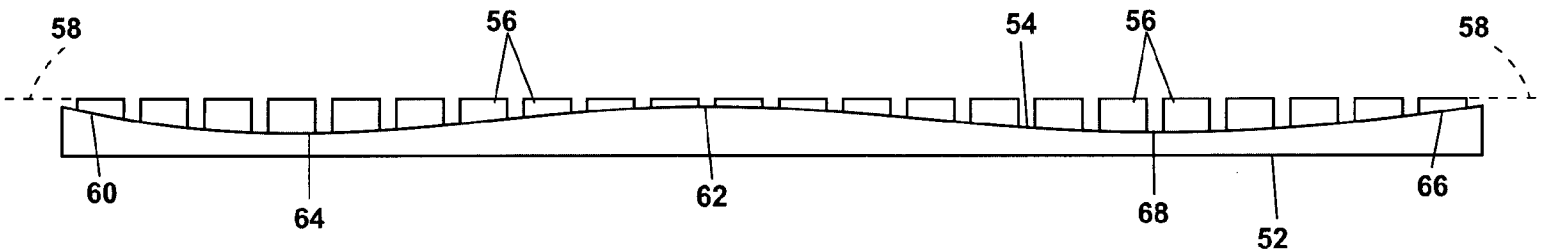
FIG. 13 is an enlarged front elevational view of the floor covering of FIG. 12.

In FIGS. 12-13, an alternate floor covering 50 is shown having a main body 51. Main body 51 includes a lower surface 52, a non-planar intermediate surface 54, a plurality of non-contiguous but adjacent lugs 56, and a substantially planar composite upper surface 58. Intermediate surface 54 includes a first raised section 60, a second raised section 62, and an intermediate lower region 64 disposed between the first raised section 60 and the second raised section 62. In addition, the intermediate surface 54 also includes a third raised section 66, and a second intermediate lower region 68 disposed between the second raised section 62 and the third raised section 66. The undulations of intermediate surface 54 define multiple liquid carrying channels disposed below a composite or virtual walking surface defined by the top surfaces of the lugs 56. The lugs extending upwardly from the lowest sections of the undulated intermediate surface 54 have the greatest height. It is also possible to modify floor covering 50 to have the undulated intermediate surface 54 slope downwardly from the rearward section 70 to the forward section 72.

Referring to FIG. 14, floor covering 80 has an undulated intermediate surface 82. In this embodiment, the liquid carrying channels have relatively steep sloping surfaces 84, which resemble the letter "V". The lower surface 86 is substantially planar. The composite upper surface 88 is defined by the top surfaces of the lugs 89 and is substantially parallel to the lower surface 86. The lug height varies over the undulated intermediate surface 82 to ensure that the composite upper surface 88 is substantially planar. Floor covering 90 is adjacent to floor covering 80 and includes an undulated intermediate surface 92, a plurality of lugs 99 with varying heights, a substantially planar lower surface 96, and a substantially planar composite upper surface 98. Together, floor covering 90 and floor covering 80 form a flooring system. The sloping surface 85 of floor covering 80 and sloping surface 95 of floor covering 90 form a channel for carrying liquid. The composite upper surface 88 aligns with composite upper surface 98 to define a substantially planar, generally uninterrupted walking surface disposed above multiple liquid carrying channels.

The floor covering is preferably manufactured using an extrusion coupled with a calendering process as is well known in the art. This process requires a flexible material, such as polyvinyl chloride (PVC) or rubber. The preferred material is PVC. It is also beneficial to incorporate additives such as a UV inhibitor to minimize premature aging, a fragrance additive to "freshen" the local environment, and a anti-microbial package to provide longevity by minimizing mold growth. Some floor covering geometries may allow for an extrusion only process. Additionally, the floor covering could be manufactured using other well known methods and be made of metal, wood, or various rigid plastics.

Referring to FIG. 3 again, the preferred dimensions of floor covering 10A will be given. From the lower surface 12 to the intermediate lower region 24, there is an approximate thickness of 0.060". The thickness increases from the intermediate lower region 24 to the first raised section 20 by approximately 0.040". Similarly, the thickness increases from the intermediate lower region 24 to the second raised section 22 by approximately 0.040". The lug height near the first and second raised sections is approximately 0.025". The lug height will increase towards the center of the intermediate channeled surface. The overall thickness of floor covering 10A will be approximately 0.125"+/−0.005". Preferably, the floor covering 10A would be 4' to 10' in width, and 20' or greater in length. However, floor covering 10A could be a 1' by 1' square piece and still achieve the advantages of the present invention. The dimensions will be dependent on the intended application. Referring to FIG. 8, the slope from rearward section 34 to forward section 32 is preferably 0.25" per 10' of length, or an angle of about 0.12°.

When the present invention is utilized in the garage environment, it can provide a durable means to protect an existing garage floor from the common elements found and used in the garage environment. Preferably, the floor covering of the present invention will have a non-porous surface that allows for easy removal of oils, gasoline, common cleaners and water. The floor covering can also act as a vapor barrier, maintaining a dry floor surface, while providing insulative properties. The lugs provide a non-skid walking surface that can minimize potential slip and fall injuries. The liquid carrying channels help to minimize the chance that a person walking on the composite upper surface will contact any spilled liquid.

Referring to FIGS. 1-2 again, the floor covering will generally follow the shape of the garage floor. The liquid carrying channels preferably extend longitudinally from the rear of the garage to the front. Most garages are designed with a slight pitch from the rear of the garage to the front. Any liquid that ends up on the floor covering will have a tendency to flow out of the garage. The floor covering can be positioned such that the garage door will close on floor covering pieces. Specifically, the garage door will stop closing when it makes contact with the upper walking surface of the floor covering. This allows for liquid to drain after the garage door has been closed. Alternatively, the floor covering pieces can be arranged such that the liquid carrying channels direct liquid toward the center of the garage, perhaps to a drain.

With the slight pitch of a garage floor, a rearward to forward slope of the floor covering is not needed. If there is no pitch, or if the pitch is not sufficient, a floor covering sloping from the rear to the front is preferred. A floor covering system as shown in FIG. 2 would require that each floor covering piece contribute to the overall slope in order to carry liquid from the rear of the garage to the front.

As previously discussed, a flooring system can be created using a plurality of flooring main bodies. Referring to FIG. 1, the flooring system shown is created from two floor coverings 10A and 10B. The main bodies of 10A and 10B are disposed adjacent each other such that one raised section of 10A aligns with one raised section of 10B. Similarly in FIG. 2, flooring coverings 10A and 10B are aligned, but only form a small section of the overall flooring system.

A floor covering main body could also be made from a plurality of components and still achieve the advantages of the present invention. For example, the floor covering main body 11 of FIG. 3 could be constructed from two pieces that when aligned, form the main body 11 as is shown. The first piece could include the first raised section 20 and half of the intermediate lower region 24. Likewise, the second piece could include the second raised section 22 and the other half of the intermediate lower region 24. When aligned, the first piece and the second piece would define the main body 11. It is also possible that the lugs are incorporated in the flooring after the main body is manufactured, such as by fastening them with glue or screws.

This concludes the detailed description section. A reading of it by those skilled in the art will bring to mind many alterations and modifications, in addition to those mentioned above, without departing from the spirit and scope of the invention. Therefore, it is intended that the invention be limited only by the appended claims.

We claim:

1. A floor covering comprising:

a main body, the main body having:

a lower surface;

a non-planar intermediate surface, the intermediate surface further comprising:

a first raised section;

a second raised section;

an intermediate lower region disposed between the first raised section and the second raised section; and a plurality of lugs extending upwardly from the intermediate surface to define a substantially planar composite upper surface defined by top surfaces of the lugs to form at least a portion of a floor, the lugs being arranged to define overlapping rows wherein at least a portion of the lugs in one row extend into a portion of an adjacent row.

2. The floor covering according to claim 1, wherein the lower surface is substantially planar.

3. The floor covering according to claim 1, wherein the intermediate lower region is substantially linear.

4. The floor covering according to claim 1, wherein the lug height varies between the first raised section and the second raised section.

5. The floor covering according to claim 1, wherein the intermediate lower region further comprises:

a forward section; and a rearward section, wherein the intermediate lower region slopes downwardly from the rearward section to the forward section.

6. The floor covering according to claim 1, further comprising:

a flap extending laterally from the lower surface adapted for engagement with another floor covering main body.

7. The floor covering according to claim 1, wherein the intermediate surface further comprises:

a third raised section; and a second intermediate lower region disposed between the second raised section and the third raised section.

8. The floor covering according to claim 1, wherein the main body is formed from a plurality of components.

9. The floor covering according to claim 1, wherein the intermediate surface slopes upwardly from the intermediate lower region to the first raised section, and from the intermediate lower region to the second raised section.

10. The floor covering according to claim 1, wherein the composite upper surface is substantially parallel to the lower surface.

11. The floor covering according to claim 1, wherein the main body further comprises a plurality of contiguous lugs extending upwardly from the intermediate surface, wherein one or more of the top surfaces of the contiguous lugs contributes in defining the substantially planar composite upper surface.

12. The floor covering according to claim 1, wherein each row comprises a plurality of lugs separated by interstitial spaces wherein the lugs of one row extend into at least a portion of the interstitial spaces of an adjacent row to define the overlapping rows.

13. The floor covering according to claim 1, further comprising a plurality of main bodies disposed adjacent to each other such that each upper surface aligns with the next adjacent upper surface to define a flooring system.

14. A flooring system comprising:

a plurality of flooring main bodies comprising:

a lower surface;

a non-planar intermediate surface, the intermediate surface further comprising:

a first raised section, a second raised section, an intermediate lower region disposed between the first raised section and the second raised section, and a plurality of lugs extending upwardly from the intermediate surface to define a substantially planar composite upper surface defined by top surfaces of the lugs to form at least a portion of a floor, the lugs being arranged to define overlapping rows wherein at least a portion of the lugs in one row extend into a portion of an adjacent row; and wherein the main bodies are disposed adjacent each other such that one of plurality of flooring main bodies first raised section aligns with another one of the plurality of flooring main bodies second raised section.

15. A floor covering main body comprising:

a lower surface;

an undulated intermediate surface disposed above the lower surface;

a plurality of non-contiguous but adjacent lugs extending upwardly from the intermediate surface;

a substantially planar composite upper surface disposed above the intermediate surface and defined by the top surfaces of the lugs.

16. The floor covering main body according to claim 15, wherein the lower surface is substantially planar.

17. The floor covering main body according to claim 15, wherein the undulated intermediate surface further comprises:

a forward section; and a rearward section, wherein the undulated intermediate surface slopes downwardly from the rearward section to the forward section.

18. The floor covering main body according to claim 15, wherein the lugs extending upwardly from the lowest sections of the undulated intermediate surface have the greatest height.

19. The floor covering main body according to claim 15, further comprising a plurality of contiguous lugs extending upwardly from the intermediate surface, wherein one or more of the top surfaces of the contiguous lugs contributes in defining the virtual substantially planar upper surface.

20. A floor covering main body according to claim 15 wherein the undulated intermediate surface defines a channeled surface.

21. The floor covering according to claim 20, further comprising a plurality of main bodies disposed adjacent to each other such that each upper surface aligns with the next adjacent upper surface to define a flooring system.

22. A floor covering main body comprising:

a lower surface;

an intermediate channeled surface; and a plurality of lugs extending upwardly from the intermediate surface to define a substantially planar composite upper surface defined by top surfaces of the lugs to form at least a portion of a floor, the lugs being arranged to define overlapping rows wherein at least a portion of the lugs in one row extend into a portion of an adjacent row.

23. The floor covering main body according to claim 22, wherein the lower surface is substantially planar.

24. The floor covering main body according to claim 22, wherein the intermediate channeled surface is substantially linear.

25. The floor covering main body according to claim 22, wherein the lug height increases towards the center of the intermediate channeled surface.

26. The floor covering main body according to claim 22, wherein the intermediate channeled surface further comprises:

a forward section; and a rearward section, wherein the intermediate channeled surface slopes downwardly from the rearward section to the forward section.

27. The floor covering main body according to claim 22, further comprising:

a flap extending laterally from the lower surface adapted for engagement with another floor covering main body.

28. The floor covering main body according to claim 22, wherein the intermediate channeled surface is undulated.

29. The floor covering main body according to claim 22, wherein the height of the intermediate channeled surface gradually decreases from an edge of the channeled surface to a center of the channeled surface.

30. The floor covering main body according to claim 22, wherein the upper composite surface is substantially parallel to the lower surface.

31. The floor covering main body according to claim 22, further comprising a plurality of contiguous lugs extending upwardly from the intermediate channeled surface, wherein one or more of the top surfaces of the contiguous lugs contributes in defining the substantially planar composite upper surface.

32. The floor covering according to claim 22, further comprising a plurality of main bodies disposed adjacent to each other such that each upper surface aligns with the next adjacent upper surface to define a flooring system.

33. A floor covering main body according to claim 22 wherein the intermediate surface defines a channeled surface to channel liquid away from the composite upper surface.

34. The floor covering according to claim 33, further comprising a plurality of main bodies disposed adjacent to each other such that each upper surface aligns with the next adjacent upper surface to define a flooring system.

35. The floor covering main body according to claim 33, wherein the lug height increases towards the center of the intermediate channeled surface.

36. The floor covering main body according to claim 33, wherein the height of the intermediate channeled surface gradually decreases from an edge of the channeled surface to a center of the channeled surface.

37. A floor covering comprising:

a main body, the main body having:

a lower surface;

a non-planar intermediate surface, the intermediate surface further comprising:

a first raised section;

a second raised section;

an intermediate lower region disposed between the first raised section and the second raised section;

a third raised section;

a second intermediate lower region disposed between the second raised section and the third raised section;

a plurality of non-contiguous but adjacent lugs extending upwardly from the intermediate surface; and a substantially planar composite upper surface defined by the top surfaces of the lugs.

38. The floor covering according to claim 37, further comprising a plurality of main bodies disposed adjacent to each other such that each upper surface aligns with the next adjacent upper surface to define a flooring system.

* * * * *